US009638015B2

(12) United States Patent
Nowitzki et al.

(10) Patent No.: US 9,638,015 B2
(45) Date of Patent: May 2, 2017

(54) ELECTRIC SUBMERSIBLE PUMP INVERTED SHROUD ASSEMBLY

(71) Applicant: Summit ESP, LLC, Tulsa, OK (US)

(72) Inventors: Wesley John Nowitzki, Broken Arrow, OK (US); Joseph Stewart, Stillwater, OK (US); Randy S. Roberts, Tulsa, OK (US); Michael Edward Sterling, Purcell, OK (US)

(73) Assignee: Summit ESP, LLC, Tulsa, OK (US)

( * ) Notice: Subject to any disclaimer, the term of this patent is extended or adjusted under 35 U.S.C. 154(b) by 0 days.

(21) Appl. No.: 14/938,439

(22) Filed: Nov. 11, 2015

(65) Prior Publication Data

US 2016/0130923 A1 May 12, 2016

Related U.S. Application Data

(60) Provisional application No. 62/078,836, filed on Nov. 12, 2014.

(51) Int. Cl.

| | |
|---|---|
| ***E21B 43/12*** | (2006.01) |
| ***F04D 29/42*** | (2006.01) |
| ***F04D 13/10*** | (2006.01) |
| ***F04D 29/08*** | (2006.01) |
| ***F04D 29/62*** | (2006.01) |

(52) U.S. Cl.

CPC ..... *E21B 43/128* (2013.01); *F04D 13/10* (2013.01); *F04D 29/086* (2013.01); *F04D 29/426* (2013.01); *F04D 29/628* (2013.01)

(58) Field of Classification Search

CPC ..... E21B 43/128; F04D 7/02; F04D 13/08; F04D 1/00; F04D 29/429

See application file for complete search history.

(56) References Cited

U.S. PATENT DOCUMENTS

| | | | |
|---|---|---|---|
| 1,776,797 | A | 9/1930 | Sheldon |
| 2,759,254 | A | 8/1956 | Soehnlen et al. |
| 3,331,621 | A | 7/1967 | Bagnulo |

(Continued)

OTHER PUBLICATIONS

Takacs, Gabor, "Use of ESP Equipment in Special Conditions," Electrical Submersible Pumps Manual: Design, Operations, and Maintenance, 2009, Gulf Professional Publishing, Burlington, MA, 140-145, 5 pages.

(Continued)

*Primary Examiner* — Brad Harcourt

(74) *Attorney, Agent, or Firm* — Frederic Dorwart, Lawyers; Penina Michlin Chiu

(57) ABSTRACT

An electric submersible pump (ESP) inverted shroud assembly is described. An ESP assembly includes an inverted shroud separating an ESP pump from a well casing, the ESP pump rotatably coupled to an ESP motor, the inverted shroud having an opening on an upstream terminal side, at least a portion of the ESP motor extending through the opening, the portion of the ESP motor extending through the opening exposed to working fluid, and the opening sealed to the working fluid. An ESP assembly includes an inverted shroud, and an ESP motor including a head, housing and base, the head of the ESP motor at least partially inside the inverted shroud, and the housing and base of the ESP motor at least partially outside the inverted shroud.

19 Claims, 5 Drawing Sheets

(56) References Cited

U.S. PATENT DOCUMENTS

| | | | | |
|---|---|---|---|---|
| 3,397,643 | A * | 8/1968 | Jepsen | F04B 17/03 417/415 |
| 3,672,795 | A * | 6/1972 | Arutunoff | E21B 43/128 415/901 |
| 3,731,710 | A | 5/1973 | Bauer et al. | |
| 3,748,066 | A | 7/1973 | Sully et al. | |
| 3,860,270 | A | 1/1975 | Arnold | |
| 3,916,502 | A | 11/1975 | Bagnulo | |
| 3,960,394 | A | 6/1976 | Hubner et al. | |
| 4,015,633 | A | 4/1977 | Mandell | |
| 4,275,319 | A | 6/1981 | Davis, Jr. | |
| 4,323,526 | A | 4/1982 | Hilbush, III | |
| 4,330,306 | A | 5/1982 | Salant | |
| 4,481,020 | A | 11/1984 | Lee et al. | |
| 4,530,397 | A | 7/1985 | Calhoun | |
| 4,605,466 | A | 8/1986 | Eisenzimmer | |
| 4,696,324 | A | 9/1987 | Petronko | |
| 4,751,965 | A | 6/1988 | Cassity | |
| 4,804,209 | A | 2/1989 | Fischer | |
| 4,806,083 | A | 2/1989 | LaGrange et al. | |
| 4,966,532 | A | 10/1990 | Fengsheng | |
| 5,355,961 | A | 10/1994 | Gariepy et al. | |
| 5,456,314 | A | 10/1995 | Boehm et al. | |
| 5,464,063 | A | 11/1995 | Boehm, Jr. | |
| 5,478,123 | A | 12/1995 | Kanao | |
| 5,628,616 | A | 5/1997 | Lee | |
| 5,853,643 | A | 12/1998 | Bauer | |
| 5,992,517 | A | 11/1999 | McAnally | |
| 6,003,873 | A | 12/1999 | Solberg | |
| 6,312,216 | B1 | 11/2001 | Falcimaigne | |
| 6,364,013 | B1 | 4/2002 | Watson et al. | |
| 6,595,295 | B1 | 7/2003 | Berry et al. | |
| 6,602,059 | B1 | 8/2003 | Howell et al. | |
| 6,691,782 | B2 | 2/2004 | Vandevier | |
| 6,755,250 | B2 | 6/2004 | Hall et al. | |
| 7,014,219 | B2 | 3/2006 | Hoppenz et al. | |
| 7,407,165 | B1 | 8/2008 | Chisnell | |
| 7,766,081 | B2 | 8/2010 | Brown et al. | |
| 7,882,896 | B2 | 2/2011 | Wilson et al. | |
| 8,141,625 | B2 | 3/2012 | Reid | |
| 8,397,811 | B2 | 3/2013 | Reid | |
| 8,435,015 | B2 | 5/2013 | Brookbank et al. | |
| 8,955,598 | B2 * | 2/2015 | Brown | E21B 43/121 166/105.5 |
| 9,175,692 | B2 | 11/2015 | Nowitzki et al. | |
| 2005/0194126 | A1 | 9/2005 | Wang | |
| 2006/0245957 | A1 | 11/2006 | Berry et al. | |
| 2009/0053080 | A1 | 2/2009 | Ives et al. | |
| 2009/0223662 | A1 | 9/2009 | Shaw et al. | |
| 2009/0272538 | A1 | 11/2009 | Kennedy | |
| 2010/0096141 | A1 | 4/2010 | Brown et al. | |
| 2010/0122818 | A1 | 5/2010 | Rooks | |
| 2010/0319926 | A1 | 12/2010 | Reid | |
| 2011/0024124 | A1 | 2/2011 | Brown et al. | |
| 2011/0073296 | A1 | 3/2011 | Richard et al. | |
| 2011/0127045 | A1 | 6/2011 | Spence et al. | |
| 2012/0195775 | A1 | 8/2012 | Pedrollo | |
| 2013/0068455 | A1 | 3/2013 | Brown et al. | |
| 2015/0053414 | A1 | 2/2015 | Reid | |
| 2015/0308245 | A1 | 10/2015 | Stewart et al. | |

OTHER PUBLICATIONS

Petrowiki, "ESP optional components," taken from http://petrowiki.org/ESP_optional_components, Last date modified Jan. 19, 2016, 5 pages.

Wu, Samuel, "Reciprocating Pumps vs. Multi-Stage Centrifugal Pumps," taken from http://www.pumpsandsystems.com/topics/pumps/reciprocating-pumps/reciprocating-pumpsvs-multi-stage-centrifugal-pumps, Date unknown, 14 pages.

* cited by examiner 195
185
140
105
625
600
605
640
630
635
170
145
100
130
150
125
610
120
220
155
190
160
115
165
110
620

ELECTRIC SUBMERSIBLE PUMP INVERTED SHROUD ASSEMBLY

CROSS REFERENCE TO RELATED APPLICATIONS

This application claims the benefit of U.S. Provisional Application No. 62/078,836 to Nowitzki et al., filed Nov. 12, 2014 and entitled "INVERTED SHROUD ASSEMBLY," which is hereby incorporated by reference in its entirety.

BACKGROUND OF THE INVENTION

1. Field of the Invention

Embodiments of the invention described herein pertain to the field of submersible pump assemblies. More particularly, but not by way of limitation, one or more embodiments of the invention enable an electric submersible pump inverted shroud assembly.

2. Description of the Related Art

Submersible pump assemblies are used to artificially lift fluid to the surface in deep wells such as oil or water wells. A typical vertical electric submersible pump (ESP) assembly consists of, from bottom to top, an electrical motor, seal section, pump intake and centrifugal pump, which are all connected together with shafts. The electrical motor supplies torque to the shafts, which provides power to the centrifugal pump. The electrical motor is generally connected to a power source located at the surface of the well using a motor lead cable. The entire assembly is placed into the well inside a casing. The casing separates the submersible pump assembly from the well formation. Perforations in the casing allow well fluid to enter the casing. These perforations are generally below the motor and are advantageous for cooling the motor when the pump is in operation, since fluid is drawn passed the outside of the motor as it makes it way from the perforations up to the pump intake.

One challenge to economic and efficient ESP operation is pumping gas laden fluid. When pumping gas laden fluid, the gas may separate from the other fluid due to the pressure differential created when the pump is in operation. If there is a sufficiently high gas volume fraction, typically about 10% or more, the pump may experience a decrease in efficiency and decrease in capacity or head (slipping). If gas continues to accumulate on the suction side of the impeller it may entirely block the passage of other fluid through the centrifugal pump. When this occurs the pump is said to be "gas locked" since proper operation of the pump is impeded by the accumulation of gas. As a result, careful attention to gas management in submersible pump systems is needed in order to improve the production of gas laden fluid from subsurface formations.

Currently in wells with gas laden fluid, and particularly in low volume, high gas wells (typically 200-500 bpd and 700-1000 MCF/d), a conventional inverted shroud is sometimes employed. In such instances, a shroud is placed around the ESP motor, enclosing the motor within the shroud, and including tubing that extends upwards towards the pump base. The bottom of the shroud around the motor is closed, creating a barrier to well fluid. The top of the shroud is open, typically attached to the pump base just above the intake. During operation, the well fluid enters perforations in the well casing located below the motor. The well fluid travels upwards in between the shroud and well casing. At the top of the shroud near the pump base, the fluid makes a 180° turn, and travels down the inside of the shroud, between the shroud and the pump assembly, and into the pump intake.

From the pump intake, the fluid enters the pump and is carried through production tubing to the surface. As the fluid makes its turn at the top of the shroud, a portion of the gas breaks out of the laden fluid prior to entry into the pump, and naturally rises to the surface. The liquid travels downwards towards the intake.

A drawback to the use of conventional inverted shrouds is that, since the motor is inside the shroud, well fluid bypasses the motor in its path through the pump assembly. Without cooling well fluid flowing around the motor, the motor risks overheating or failure due to the lack of cool, fresh flowing fluid passing by. One approach to cooling the motor in ESP assemblies making use of inverse shrouds is a recirculation pump. The problem with recirculation pumps is that they require a thin-walled and fragile recirculation tube. This recirculation tube is easily pinched or broken. The fragile nature of the recirculation tube requires a very careful and slow installation process. If the recirculation pump fails, the motor may overheat, leading to failure. In addition, recirculation pumps are expensive since they require an additional pump be added into the ESP assembly.

It would be an advantage for submersible pump assemblies making use of inverted shrouds to be better suited to keeping the motor cool. Therefore, there is a need for an improved inverted shroud assembly.

BRIEF SUMMARY OF THE INVENTION

Embodiments described herein generally relate to an electric submersible pump (ESP) inverted shroud assembly. An ESP inverted shroud assembly is described.

An illustrative embodiment of an ESP assembly includes an inverted shroud separating an ESP pump from a well casing, the ESP pump rotatably coupled to an ESP motor, the inverted shroud having an opening on an upstream terminal side, at least a portion of the ESP motor extending through the opening, the portion of the ESP motor extending through the opening exposed to working fluid, and the opening sealed to the working fluid. In some embodiments, the ESP assembly includes a first taper around an outer diameter of the ESP motor and a second taper around an inner diameter of the inverted shroud, the first and second tapers wedged together. In certain embodiments, the first and second tapers are of equal angle. In some embodiments, the ESP assembly includes an elastomeric ring compressed between the ESP motor and the inverted shroud adjacent to the opening. In certain embodiments, the upstream terminal side of the inverted shroud terminates at a motor protector. In some embodiments, the upstream terminal side of the inverted shroud terminates at a head of the motor. In certain embodiments, the head of the motor is tapered and wedged to the inverted shroud. In some embodiments, the ESP assembly includes a clamp securing the inverted shroud to a production tubing. In some embodiments, the inverted shroud comprises an inlet having at least one fluidly coupling an inner diameter of the inverted shroud and an outer diameter of the inverted shroud. In certain embodiments, the inlet extends between a shroud clamp and shroud tubing.

An illustrative embodiment of an ESP assembly includes an inverted shroud, and an ESP motor, the ESP motor including a head, housing and base, the head of the ESP motor at least partially inside the inverted shroud, and the housing and base of the ESP motor at least partially outside the inverted shroud. In some embodiments, the inverted shroud forms a working fluid pathway that contacts the motor housing and the motor base, passes downstream along an outer diameter of the inverted shroud, proceeds through an inlet of the inverted shroud to an inner diameter of the inverted shroud, along the inner diameter of the inverted shroud to an intake of an ESP pump and up through production tubing. In certain embodiments, the ESP assembly includes a seal to working fluid between the head of the ESP motor and the inverted shroud. In certain embodiments, the ESP assembly includes a first taper around an outer diameter of the head and a second taper around an inner diameter of the inverted shroud, the first and second tapers wedged together. In some embodiments, the first and second tapers are of equal angle.

An illustrative embodiment of an ESP assembly includes an ESP pump rotatably coupled to an ESP motor, a production tubing extending between the ESP pump and a surface of the well, a tubular shroud string surrounding the ESP pump and coupled on a downstream side to the production tubing, the ESP motor at least partially extending through and upstream of a terminal opening on an upstream side of the tubular shroud string, and the terminal opening on the upstream side of the tubular shroud string circumferentially surrounding the ESP motor and sealed to working fluid. In some embodiments, the ESP motor and the upstream side of the tubular shroud string include matching tapers at least partially forming the seal to working fluid. In certain embodiments, the ESP assembly includes a taper formed on an outer diameter of the motor, and a seat formed on an inner diameter of the tubular shroud string, wherein the taper and the seat wedge together to at least partially form the seal to working fluid. In some embodiments, the ESP assembly includes an elastomeric ring compressed between the upstream side of the tubular shroud string and the ESP motor, the elastomeric ring at least partially sealing the terminal opening to working fluid. In certain embodiments, the tubular shroud string terminates on a downstream half of the ESP motor. In some embodiments, the ESP assembly includes a clamp, wherein the clamp couples the tubular shroud string to the production tubing. In certain embodiments, the ESP assembly includes a shroud inlet secured between the clamp and the tubular shroud string, the shroud inlet comprising at least one aperture coupling a space between a well casing and the tubular shroud string to an annular clearance between the tubular shroud string and the ESP pump.

In further embodiments, features from specific embodiments may be combined with features from other embodiments. For example, features from one embodiment may be combined with features from any of the other embodiments. In further embodiments, additional features may be added to the specific embodiments described herein.

BRIEF DESCRIPTION OF THE DRAWINGS

Advantages of the present invention may become apparent to those skilled in the art with the benefit of the following detailed description and upon reference to the accompanying drawings in which.

Figure 1:
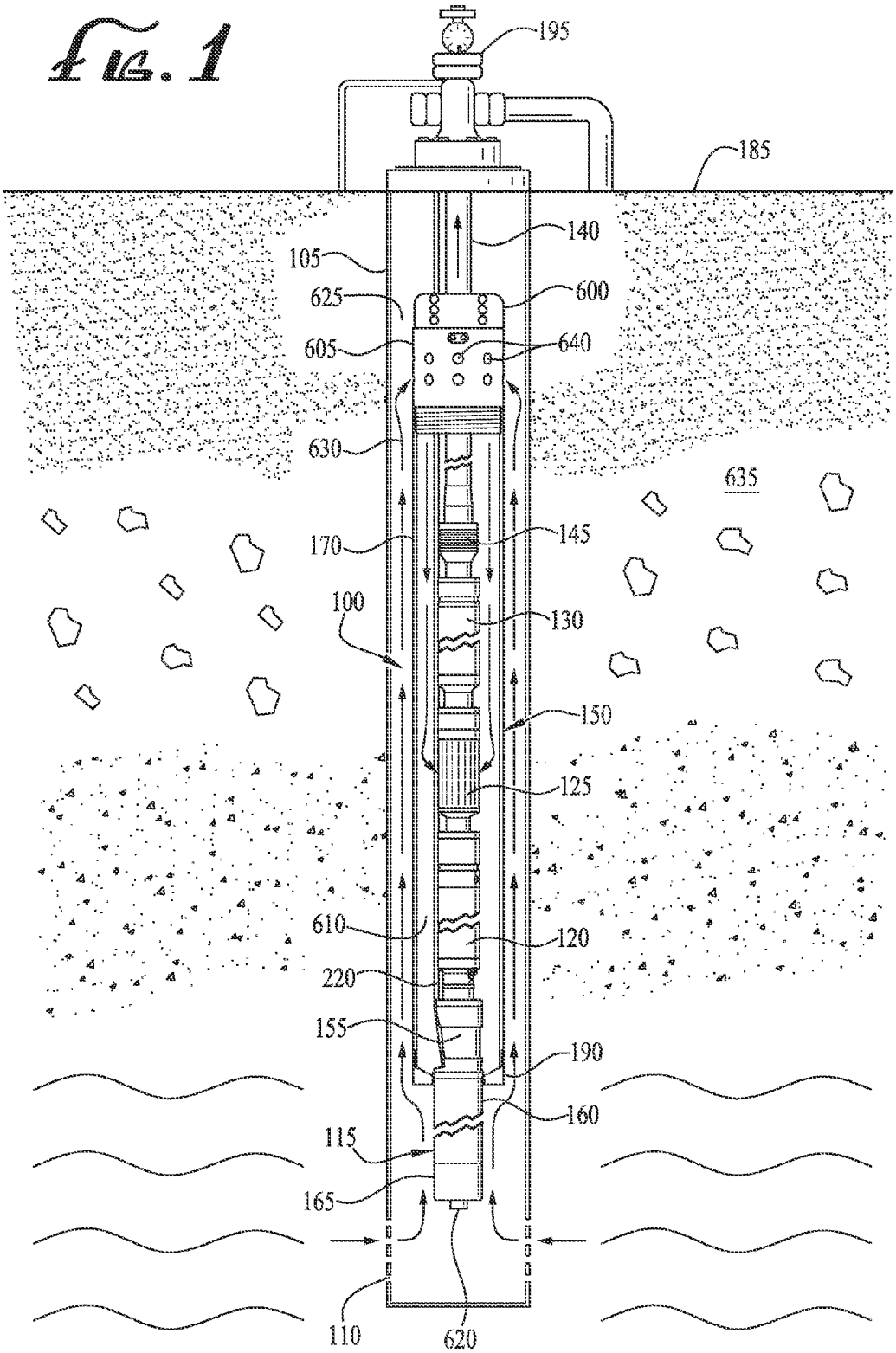
FIG. 1 is a perspective view of an exemplary submersible pump assembly with an inverted shroud of illustrative embodiments and illustrating an exemplary working-fluid flow path.

While the invention is susceptible to various modifications and alternative forms, specific embodiments thereof are shown by way of example in the drawings and may herein be described in detail. The drawings may not be to scale. It should be understood, however, that the embodiments described herein and shown in the drawings are not intended to limit the invention to the particular form disclosed, but on the contrary, the intention is to cover all modifications, equivalents and alternatives falling within the scope of the present invention as defined by the appended claims.

DETAILED DESCRIPTION

An electric submersible pump (ESP) inverted shroud assembly will now be described. In the following exemplary description, numerous specific details are set forth in order to provide a more thorough understanding of embodiments of the invention. It will be apparent, however, to an artisan of ordinary skill that the present invention may be practiced without incorporating all aspects of the specific details described herein. In other instances, specific features, quantities, or measurements well known to those of ordinary skill in the art have not been described in detail so as not to obscure the invention. Readers should note that although examples of the invention are set forth herein, the claims, and the full scope of any equivalents, are what define the metes and bounds of the invention.

As used in this specification and the appended claims, the singular forms "a", "an" and "the" include plural referents unless the context clearly dictates otherwise. Thus, for example, reference to a shroud may include one or more shrouds.

"Coupled" refers to either a direct connection or an indirect connection (e.g., at least one intervening connection) between one or more objects or components. The phrase "directly attached" means a direct connection between objects or components.

As used in this specification and the appended claims, "downstream" with respect to a downhole ESP assembly refers to the direction towards the wellhead.

As used in this specification and the appended claims, "upstream" refers to the direction deeper into the well and/or away from the wellhead.

As used in this specification and the appended claims, the terms "inner" and "inwards" with respect to a shroud or other pump assembly component refer to the radial direction towards the center of the shaft of the pump assembly.

As used in this specification and the appended claims, the terms "outer" and "outwards" with respect to a shroud or other pump assembly component refer to the radial direction away from the center of the shaft of the pump assembly.

Illustrative embodiments of the invention described herein provide an improved inverted shroud assembly that allows cooling well fluid, which enters the well casing through perforations upstream of the ESP motor, to flow past the motor before being diverted to the outer diameter of the shroud, between the shroud and the well casing, and up towards the production tubing. The shroud may be a shroud string up to two-hundred feet long or longer. The top of the shroud may be secured to the production tubing with a clamp, which may allow for the shroud to have an increased length as compared to conventional inverted shrouds. As the well fluid reaches a shroud inlet member just below the clamp, the well fluid may pass through apertures in the shroud inlet member to the inside of the shroud, and flow downwards in the annular clearance between the shroud and the pump assembly, towards the ESP intake. As the well fluid flows downward inside the shroud, gas trapped in the well fluid may break out of the fluid, such that fluid entering the pump intake includes a reduced gas to liquid ratio (GLR) as compared to fluid found inside the well before entering the pump.

Illustrative embodiments of the invention may include a motor that protrudes outside and/or upstream of the upstream end of the inverted shroud to allow well fluid to cool the motor as it passes by the motor. The base of the shroud and motor head may be sealed with a matching taper of equal angle that wedges the motor and shroud together. Well fluid flowing past the portion of the motor outside of the shroud (such as the portion of the motor including motor bearings and/or motor windings) may not pass through the seal, and instead after passing by the motor may be diverted around the outside of the shroud between the shroud and the well casing. The shroud base may also include an alternative or additional sealing mechanism such as an elastomeric ring seated in a groove and compressed between the motor and shroud base.

Illustrative embodiments allow an inverted shroud to be employed in downhole ESP applications without the need for an expensive and unreliable recirculation pump, and the complicated head adapters and flimsy piping common to recirculation pump designs. Illustrative embodiments provide a low cost gas separation process that may reduce gas entering the pump in high GLR environments. A shroud of increased length may also be employed to maximize fluid column height above the intake, which may override large gas slugs that may undesirably cause conventional ESP systems to continuously cycle or prematurely fail.

FIG. 1 is an illustrative embodiment of an electric submersible pump (ESP) assembly with an inverted shroud of an illustrative embodiment. ESP assembly 100 may be vertical or angled downhole in a well. For example, the well may be an oil well, water well, and/or well containing other hydrocarbons, such as natural gas, and/or another production fluid. ESP assembly 100 may be separated from well formation 635 by well casing 105. In an exemplary embodiment, casing 105 may be about seven inches in diameter. Working fluid 630 may enter well casing 105 through perforations 110, which may be upstream of motor 115 of ESP assembly 100. Downstream of motor 115 may be motor protector 120, ESP intake 125, multi-stage centrifugal ESP pump 130 and production tubing 140. Other components of ESP assemblies may also be included in ESP assembly 100, such as a charge pump or gas separator. Shafts of motor 115, motor protector 120, ESP intake 125 and ESP pump 130 may be connected together (i.e., splined) and be rotated by shaft of motor 115. Production tubing 140 may carry working fluid 630 towards wellhead 195 and be attached to centrifugal ESP pump 130 with bolt-on discharge 145. Downhole sensors 620 may detect motor speed, internal motor temperature, pump discharge pressure, downhole flow rate and/or other operating conditions and communicate that information to a controller (not shown) on surface 185. In an exemplary embodiment, motor 115 may be a two-pole, three-phase squirrel cage induction motor. Motor 115 may include head 155 that couples motor 115 to motor protector 120, housing 160 that houses the operative portions of motor 115 such as motor bearings and motor stator windings, and motor base 165 which completes the motor and allow attachment and/or incorporation of downhole sensors 620.

As shown in FIG. 1, shroud assembly 150 may include a string of shroud tubing 170, and may extend between production tubing 140 and motor head 155 and/or the downstream portion of motor 115. In some embodiments, shroud assembly 150 may terminate short of motor 115, such as at motor protector 120, although placing the terminal, upstream end of shroud assembly 150 at motor head 155 may simplify the installation process due to the presence of motor lead cable 220 that extends into motor 115 and provides power from surface 185 to motor 115. Shroud assembly 150 may also extend slightly below motor head 155, although the operative portion of motor 115, such as motor bearings and motor stator windings encased in housing 160, should remain substantially unshrouded so as to benefit from the passage of cooling working fluid 630. In particular, the motor bearings and electrical windings in the stator of the motor, encased by motor housing 160, may remain unshrouded (be outside of shroud assembly 150) to benefit from the passage of cooling working fluid 630. Shroud assembly 150 may be surrounded by well casing 105, with space 625 in between the outer diameter of shroud assembly 150 and the inner diameter of casing 105. In one example, shroud assembly 150 may be about 200 feet long, 5.5 inches in diameter and 15.5 pounds per foot.

Shroud base 190 may be threaded onto the terminal upstream end of shroud tubing 170 and/or be the terminal, upstream end of shroud assembly 150. Shroud base 190 of shroud assembly 150, and motor head 155 and/or the location along ESP assembly 100 located at the upstream, terminal end of shroud assembly 150, may be sealed from working fluid 630 to prevent well fluid with a high GLR, such as 200-500 bpd and 700-1000 MCF/d, from bypassing shroud assembly 150 and proceeding directly to intake 125. Motor 115 may protrude, extend through and/or at least partially extend upstream of, opening 225 in shroud base 190, and the connection may be circumferentially sealed from working fluid 630. In the example shown in FIG. 2A and FIG. 2B, shroud base 190 and motor head 155 may be sealed by seating and/or wedging motor head 155 on shroud base 190. In the illustrative example of FIG. 2A, shroud assembly 150 terminates at motor head 155. In some embodiments, shroud assembly 150 may extend a few inches below motor head 155 over motor housing 160, but shroud assembly 150 of illustrative embodiments does not substantially cover the operative portions of motor 115, such as motor bearings and electrical windings in the motor stator. As shown in FIG. 2A, motor housing 160 and motor base 165 extend below and/or are outside of shroud assembly 150 and are not enclosed by it to allow working fluid 630 to pass by and cool motor housing 160 and motor base 165.

Figure 3:
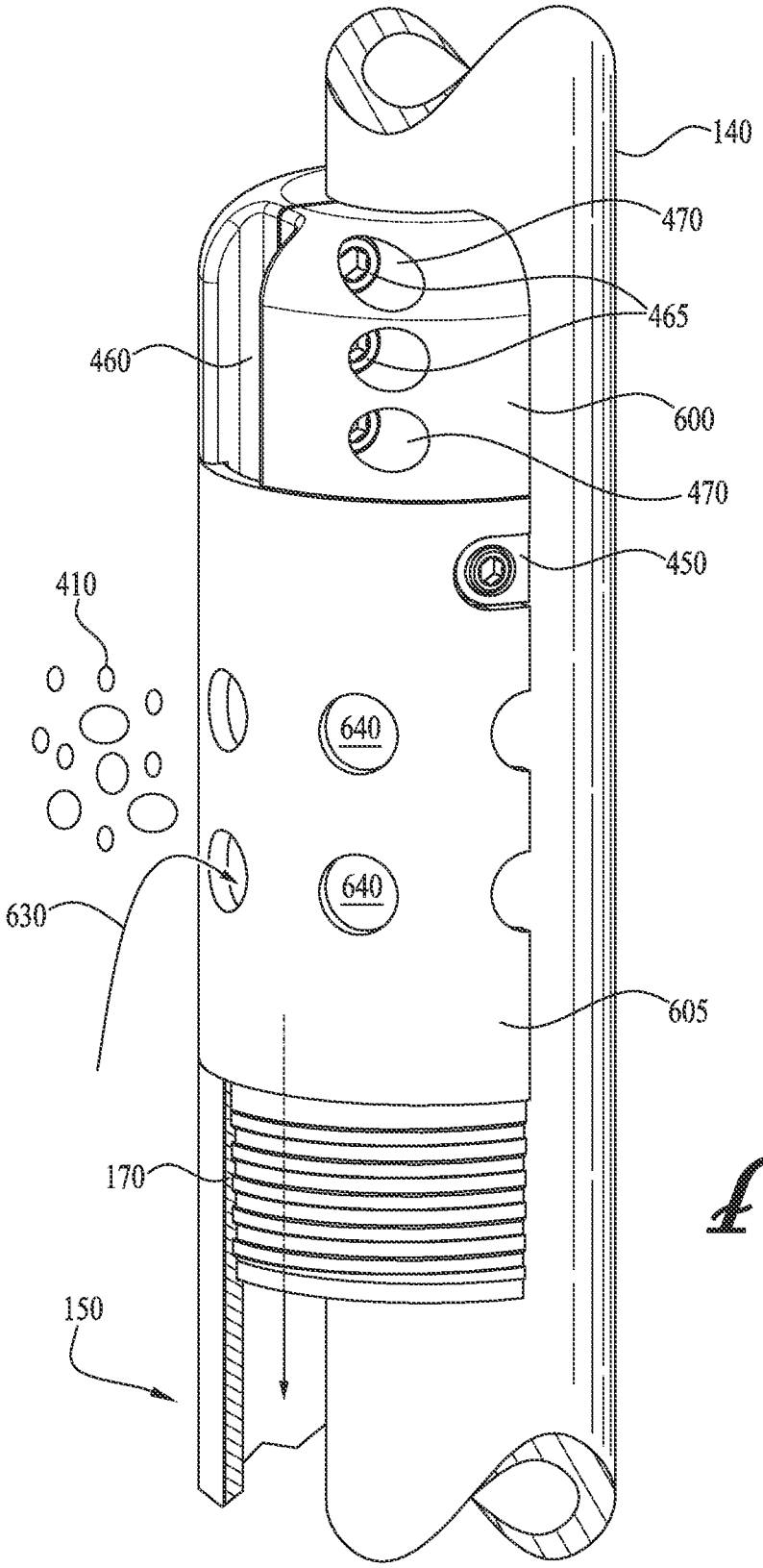
FIG. 3 is a perspective view of a shroud of an illustrative embodiment secured to production tubing.

As shown in FIG. 3, shroud assembly 150 may be attached on a downstream side to production tubing 140 and/or ESP pump 130. Shroud assembly 150 may be secured at any selected point along production tubing 140. In this fashion, shroud assembly 150 may be longer and/or extend further downstream than conventional shrouds, and therefore may be more effective in combatting gas slugs. Shroud inlet 605 may be threaded to the downstream side of shroud tubing 170 and include apertures 640 through which working fluid may pass to the inside of shroud assembly 150. Clamp 600 may be secured to the downstream end of shroud inlet 605 and complete shroud assembly 150.

Clamp 600 may secure shroud assembly 150 to production tubing 140. Clamp 600 may be split and tightly bolted around production tubing 140. Shroud inlet 605 may be secured by shear key 450 to clamp 600, with shroud tubing 170 threaded to shroud inlet 605 and hanging in an upstream direction towards motor 115. In this fashion, shroud assembly 150 may circumferentially surround ESP assembly 100 with annular clearance 610 in between the inner diameter of shroud assembly 150 and the outer diameter of ESP assembly 100 to allow working fluid 630 to flow through shroud apertures 640 and fall downwards inside shroud assembly 150 through annular clearance 610. Well fluid flowing downwards inside shroud assembly 150 may fall until it enters well intake 125, where it is lifted through centrifugal ESP pump 130 and production tubing 140 back towards well surface 185 and/or wellhead 195.

Shroud to ESP Assembly Seal

Figure 2B:
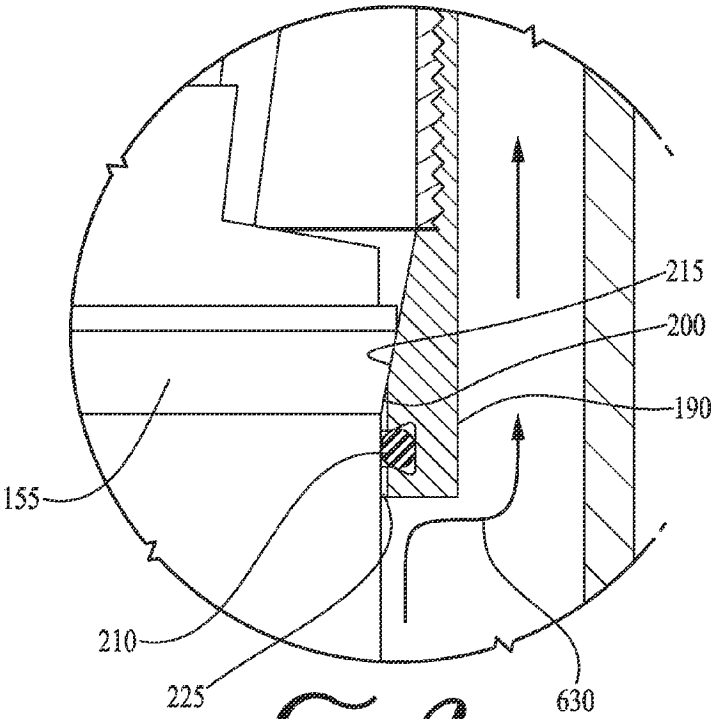
FIG. 2B is an enlarged view of FIG. 2A of an exemplary seal between a shroud base and motor of an illustrative embodiment.
Figure 2A:
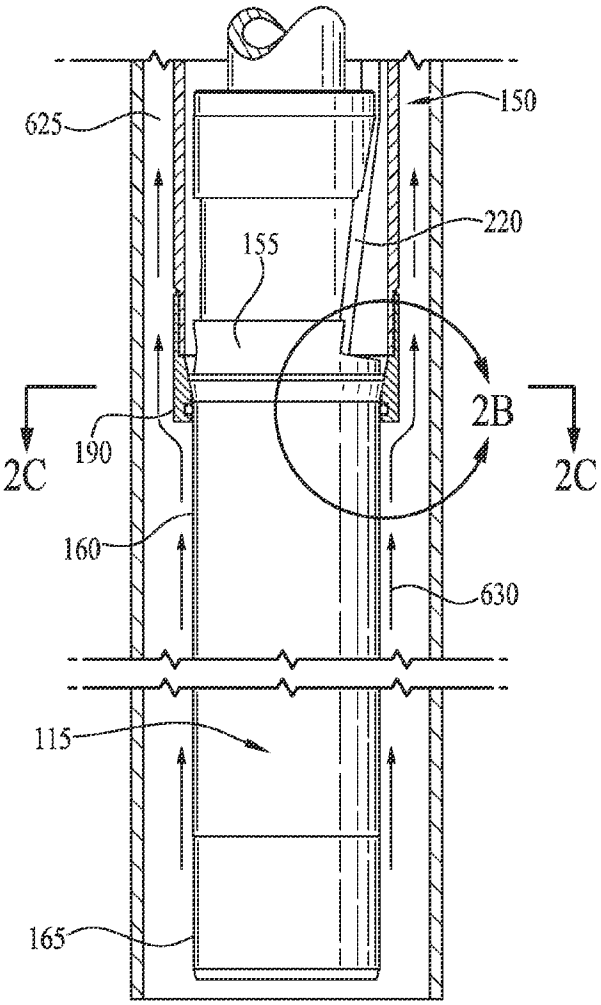
FIG. 2A is a perspective view of a motor and shroud base of an illustrative embodiment.
Figure 2C:
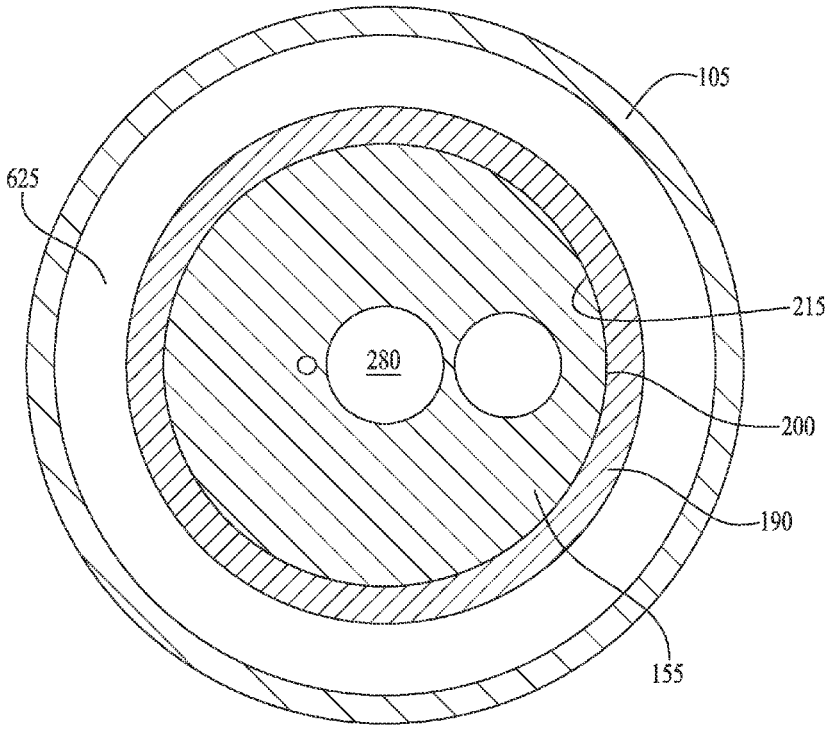
FIG. 2C is a cross sectional view across line 2C-2C of FIG. 2A of a shroud and motor of an illustrative embodiment.

Turning to FIGS. 2A-2C, the inner diameter of shroud base 190, proximate the terminal, upstream side of shroud assembly 150, may be sealed to the outer diameter of ESP assembly 100, for example motor head 155, as shown in FIGS. 2A-2C. FIGS. 2A-2C illustrate an exemplary shroud base 190 and motor head 155 sealed to working fluid 630. In FIG. 2C, central orifice 280 is shown, through which a motor shaft would extend. Shroud base 190 may thread and/or bolt onto the upstream end of shroud tubing 170. Shroud base 190 may be shaped and/or angled on an inner diameter to form seat 215 and interface with motor head 155. Seat 215 may be a slant on the inner diameter of shroud base 190, slanting outwards as judged from upstream end of base 190. In one example, seat 215 may slope at about 11° from vertical and/or the longitudinal axis of ESP assembly 100. In illustrative embodiments, angle of seat 215 may be between 5° and 13° from vertical. With angles steeper than 5° from vertical, motor head 155 may become stuck to shroud base 190, and in some embodiments, the geometry may prevent an angle shallower than 13° from vertical. In another example, seat 215 may be a shoulder and motor head 155 may be configured to interface with the shoulder without hanging.

Rather than being vertical and/or parallel to the longitudinal axis of ESP assembly 100 as with conventional motors, the outer diameter of motor head 155 and/or the location on ESP assembly 100 where base 190 is sealed, may be cone-like in shape to form taper 200, which may taper outward as judged from below motor head 155. Motor head 155 may be shaped to form taper 200 and/or a tapered attachment may be included on motor head 155 to provide for taper 200. Taper 200 may be a matching taper of equal angle to seat 215. Taper 200 may wedge tightly against seat 215 of base 190, such that a seal to well fluid is formed between shroud base 190 and motor head 155 or other seal location along ESP assembly 100, around the circumference of the interface. Where seat 215 slopes at 11° from vertical, taper 200 may similarly be 11° from vertical. In one example, the seat 215 may be about 0.40" tall, and the total area of seat 215 may be approximately 5.861 $in^2$. A seal to well fluid may also be formed with an elastomeric ring instead of, or in addition to, seat 215 and taper 200 seal. Elastomeric ring 210 may be inserted in a groove extending around shroud base 190. The pressure of motor head 155 on shroud base 190 may compress elastomeric ring 210 creating a seal to working fluid 630. Elastomeric ring 210 may be pressed into a dovetail O-ring groove in shroud base 190, such that elastomeric ring 210 will be contained and may not dislodge as motor head 155 is threaded through opening 225 in shroud base 190. In some embodiments, elastomeric ring 210 may provide a secondary and/or backup seal to the wedge created by taper 200 and seat 215.

FIG. 1 illustrates an exemplary passage of well fluid through an ESP assembly of illustrative embodiments. Working fluid 630 may enter casing 105 at perforations 110 upstream of motor base 165. Working fluid 630 may then flow passed at least a portion of motor 115 and downstream through space 625 between casing 105 and shroud assembly 150. Because a seal to well fluid may be formed between shroud assembly 150 and ESP assembly 100 at the wedged interface and/or seal between motor 115 and shroud base 190, working fluid 630 may flow around the outer diameter of shroud assembly 150 through space 625, rather than directly into pump intake 125, as illustrated in FIG. 2B. The seal of illustrative embodiments may direct well fluid around the outer diameter of shroud assembly 150 and towards wellhead 195 rather than permitting working fluid 630 to bypass shroud assembly 150 and flow directly towards pump intake 125. Although the wedge between seat 215 and taper 200 forms a circumferential seal to well fluid, should the seal leak or fail, in some embodiments elastomeric ring 210 may nonetheless provide a seal to well fluid. In the unlikely event that all sealing features fail, ESP assembly may still continue to operate despite the failure since motor 115 may still be cooled by working fluid 630 flowing by motor 115. This feature of illustrative embodiments provides an advantage over conventional recirculation pump designs, since in those conventional designs, if the recirculation pump fails, the motor temperature may rise. This may either lead to motor shut down or motor failure which may result in having to remove the ESP assembly from the well.

As shown in FIG. 3, once working fluid 630 reaches apertures 640 of shroud inlet 605, working fluid may make a turn, and flow back upstream through annular clearance 610 between the inner diameter of shroud assembly 150 and the outer diameter of ESP assembly 100. As working fluid 630 changes directions from downstream to upstream, gas 410 may break out of working fluid 630, as schematically illustrated in FIG. 3. Working fluid 630 may then continue downstream until it reaches pump intake 125, where it may be taken into ESP pump 130 and continue downstream through production tubing 140 to surface 185.

Shroud Clamp

FIG. 3 details an illustrative embodiment of shroud assembly 150 attached to production tubing 140. Shroud tubing 170 may be threaded onto shroud inlet 605 and extend down towards motor head 155 in a string of shroud tubing 170. Shroud tubing 170 may be placed over the production tubing 140 and slid into position before it is threaded to shroud inlet 605.

Once shroud tubing 170 is secured, clamp 600 may be installed to production tubing 140. As shown in FIG. 3, clamp 600 may be secured to shroud inlet 605 by shear key 450. Clamp 600 may be two pieces, for example split at motor lead cable pathway 460, and bolted together at a given torque to assure clamp 600 friction is enough to hold shroud assembly 150 but not excessive to damage production tubing 140. Clamp may be secured by bolts 465. In one example, clamp 600 may be secured by two columns and three rows of bolts 465 and washers. Clamp 600 may allow motor lead cable 220 to extend down to motor 115 unimpeded. Shroud assembly 150 may be locked in place within a five to six inch variation along production tubing, as clamp 600 may be secured at virtually any location on the production tubing 140. At this point the ESP assembly 100 may be lowered to be installed in the well as is well known to those of skill in the art.

Figure 4:
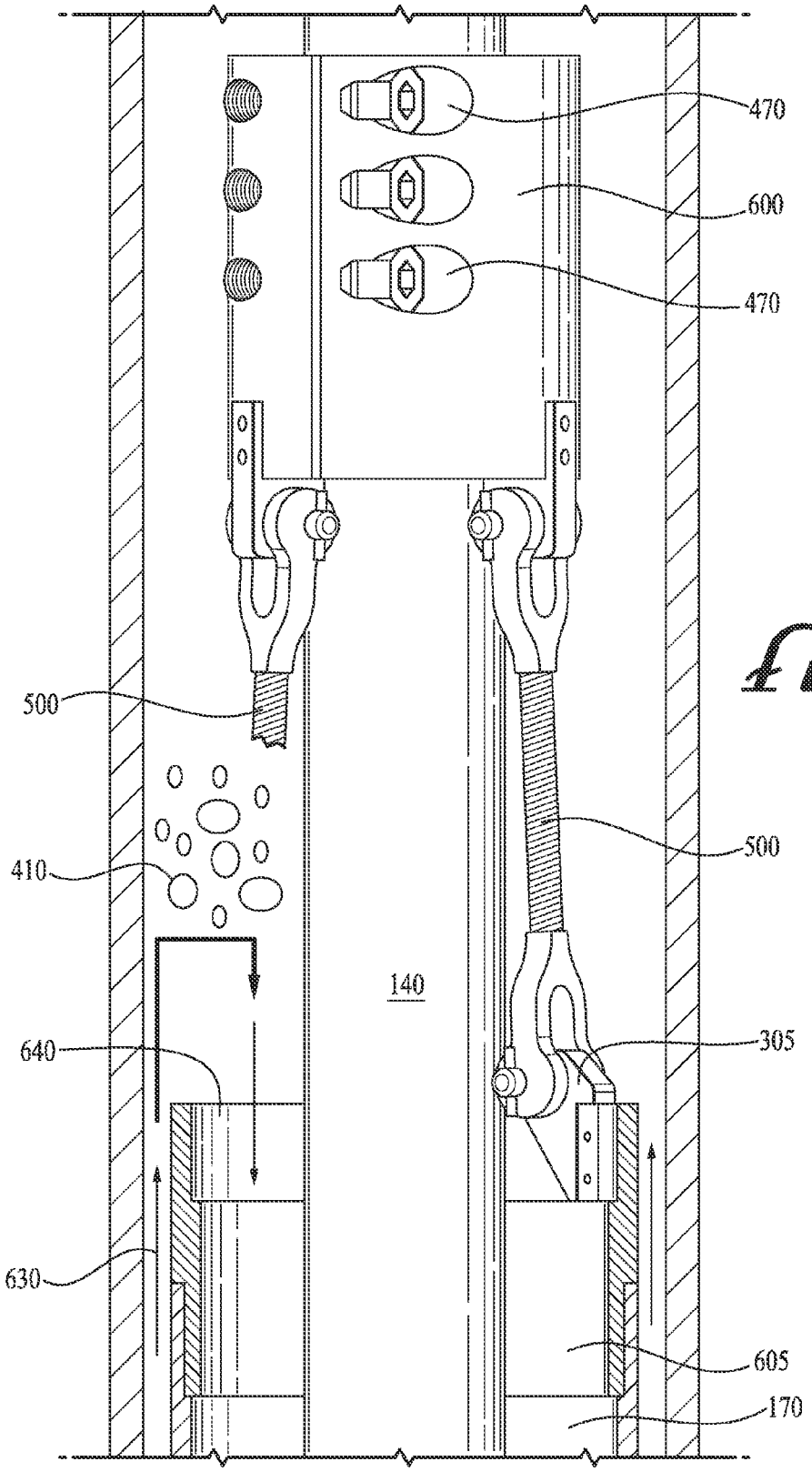
FIG. 4 is a perspective view of a shroud of an illustrative embodiment secured to production tubing.

FIG. 4 illustrates another illustrative embodiment of shroud assembly 150 attached to production tubing 140, with a part of a turnbuckle broken away for illustration purposes. In the embodiment shown in FIG. 4, turnbuckles 500 may couple clamp 600 to gussets 305 on shroud inlet 605. Once clamp 600 is securely in place, the turnbuckles 500 may be pinned to clamp 600. Turnbuckles 500 may then be turned to take up any slack and may be wired to prevent any turn back. In this fashion, shroud assembly 150 may surround ESP assembly 100 with annular clearance 610 in between the inner diameter of shroud assembly 150 and the outer diameter of ESP assembly 100 to allow fluid to flow around the downstream side of shroud inlet 605 and inside shroud assembly 150. In the embodiment of FIG. 4, aperture 640 is a single aperture on the downstream side of shroud inlet 605.

Returning to FIG. 1, during operation of ESP assembly 100, working fluid 630 may flow upwards between casing 105 and shroud assembly 150 through space 625, through aperture(s) 640, and then between shroud assembly 150 and ESP assembly 100 through annular clearance 610. As working fluid 630 passes through apertures 640, working fluid 630 may make a 180° turn, and in the process, gas 410 may break out of working fluid 630. As shown in FIG. 3 and FIG. 4, gas 410 may break from solution as the flow direction of working fluid 630 changes 180°, for example from upwards to downwards. In illustrative embodiments, about 50% of gas may be removed from working fluid 630 in ESP assemblies making use of an inverted shroud assembly 150 of illustrative embodiments. Working fluid 630 flowing through annular clearance 610 may have reduced gas content and may continue inside shroud assembly 150 until it reaches intake 125, at which point it is drawn inside of ESP pump 130.

Installing an Inverted Shroud

Inverted shroud assembly 150 may consists of internal and external threaded shroud tubing 170. The length of shroud tubing 170 connected in series may depend on specific well conditions but could range from 20 ft. up to 500 ft. in tubing length. Adapters may be threaded on to the top and bottom of the shroud string to allow for threaded connection of shroud base 190, shroud tubing 170, clamp 600 and/or shroud inlet 605. Before ESP assembly 100 is lowered, shroud tubing 170 may be lowered into casing 105, shroud base 190 may be attached to the upstream end of shroud tubing 170, and shroud inlet 605 may be secured to the downstream end of shroud tubing 170. At this point the shroud tubing 170 string with shroud base 190 and shroud inlet 605 may be lowered into casing 105 to the prescribed depth. Shroud tubing 170 and shroud base 190 may be held in place on slips as ESP assembly 100 is assembled in a procedure well known to those of skill in the art.

As the ESP assembly 100 lowers down into shroud tubing 170, motor base 165 and at least a portion or all of motor housing 160 may thread through opening 225 in shroud base 190 and the ESP assembly 100 may land on shroud base 190, for example at motor head 155. Seat 215 of shroud base 190 may land taper 200 and create a seal around and between motor head 155 or other location of ESP assembly 100 on the one hand, and shroud base 190 on the other hand. Taper 200 pressed on seat 215 may provide a seal to working fluid 630. Elastomeric ring 210 may provide a sealing feature instead of, or in addition to, taper 200 on seat 215.

Once ESP assembly 100 is resting on shroud base 190, an ESP technician may attach clamp 600 to shroud inlet 605, for example by shear key 450, and bolt the two halves of clamp 600 tightly around production string 140, holding shroud assembly 150 in position. In an exemplary embodiment, clamp 600 may include rows of one-inch bolt holes 470. Bolt-holes 470 may be evenly distributed around clamp 600. In one example, clamp 600 may be secured by two columns and three rows of bolts 465 and washers perpendicular to the split. Bolts 465 may be secured into bolt-holes 470 to firmly attach clamp 600 to production tubing 140. Once the clamp 600 is in place, the entire shroud assembly 150 and ESP assembly 100 may be lowered into the ground under install procedures well known to those of skill in the art. Illustrative embodiments may be installed in about one day, as compared to two days installation time for conventional inverted shroud recirculation pump systems.

Because shroud assembly 150 may be attached to production tubing 140 at nearly any point along the tubing, illustrative embodiments may allow for a longer shroud assembly that is better able to handle gas slugs. The seal between shroud assembly 150 and ESP assembly 100 of illustrative embodiments may allow the operative portion of ESP motor 115 to remain in the flow of cooling well fluid whilst still employing an inverted shroud, eliminating the need for a recirculation pump in high GLR/low volume applications making use of an inverted shroud.

An electric submersible pump (ESP) inverted shroud assembly has been described. Further modifications and alternative embodiments of various aspects of the invention may be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the scope and range of equivalents as described in the following claims. In addition, it is to be understood that features described herein independently may, in certain embodiments, be combined.

What is claimed is:

1. An electric submersible pump (ESP) assembly comprising:

an inverted shroud separating a centrifugal ESP pump from a well casing, the centrifugal ESP pump rotatably coupled to an ESP motor;

the inverted shroud having an opening on an upstream terminal side, the upstream terminal side terminating at a head of the ESP motor;

at least a portion of the ESP motor extending through the opening;

the portion of the ESP motor extending through the opening exposed to working fluid;

the opening sealed to the working fluid at the head of the ESP motor, the head of the ESP motor tapered and wedged to the inverted shroud; and the inverted shroud forming a working fluid pathway that extends upwards passed a housing of the ESP motor and upward along an outer diameter of the inverted shroud, proceeds through an inlet of the inverted shroud to an inner diameter of the inverted shroud, makes a turn to extend downwards from the inlet along the inner diameter of the inverted shroud to an intake of the centrifugal ESP pump, and after entering the intake continuing upwards through production tubing.

2. The ESP assembly of claim 1, comprising a first taper around an outer diameter of the head of the ESP motor and a second taper around an inner diameter of the inverted shroud, the first and second tapers wedged together.

3. The ESP assembly of claim 2, wherein the first and second tapers are of equal angle.

4. The ESP assembly of claim 2, wherein the angle is between five degrees and thirteen degrees from vertical.

5. The ESP assembly of claim 1, comprising an elastomeric ring compressed between the ESP motor and the inverted shroud adjacent to the opening.

6. The ESP assembly of claim 1, further comprising a clamp securing the inverted shroud to a production tubing.

7. The ESP assembly of claim 1, wherein the inlet has at least one aperture fluidly coupling an inner diameter of the inverted shroud and an outer diameter of the inverted shroud.

8. The ESP assembly of claim 7, wherein the inlet extends between a shroud clamp and shroud tubing.

9. An electric submersible pump (ESP) assembly comprising:

an inverted shroud;

an ESP motor, the ESP motor comprising a head, housing and base;

the head of the ESP motor at least partially inside the inverted shroud;

the housing and base of the ESP motor at least partially outside the inverted shroud; and a working fluid pathway that extends upwards passed a housing of the ESP motor and upward along an outer diameter inverted shroud, proceeds through an inlet of the inverted shroud to an inner diameter of the inverted shroud, makes a turn to extend downwards from the inlet along the inner diameter of the inverted shroud to an intake of a centrifugal ESP pump, and after entering the intake continuing upwards through production tubing.

10. The ESP assembly of claim 9, comprising a seal to working fluid between the head of the ESP motor and the inverted shroud.

11. The ESP assembly of claim 9, comprising a first taper around an outer diameter of the head and a second taper around an inner diameter of the inverted shroud, the first and second tapers wedged together.

12. The ESP assembly of claim 11, wherein the first and second tapers are of equal angle.

13. An electric submersible pump (ESP) assembly comprising:

a centrifugal ESP pump rotatably coupled to an ESP motor;

a production tubing extending between the centrifugal ESP pump and a surface of the well;

a tubular shroud string surrounding the centrifugal ESP pump and coupled on a downstream side to the production tubing;

the ESP motor at least partially extending through and upstream of a terminal opening on an upstream side of the tubular shroud string;

the terminal opening on the upstream side of the tubular shroud string circumferentially surrounding the ESP motor and sealed to working fluid; and wherein the ESP motor and the upstream side of the tubular shroud string comprise matching tapers at least partially forming the seal to working fluid.

14. The ESP assembly of claim 13, wherein the matching tapers comprise a motor taper formed on an outer diameter of the motor, and a seat formed on an inner diameter of the tubular shroud string, wherein the motor taper and the seat wedge together to at least partially form the seal to working fluid.

15. The ESP assembly of claim 13, further comprising an elastomeric ring compressed between the upstream side of the tubular shroud string and the ESP motor, the elastomeric ring at least partially sealing the terminal opening to working fluid.

16. The ESP assembly of claim 13, wherein the tubular shroud string terminates at a head of the ESP motor.

17. The ESP assembly of claim 13, wherein the tubular shroud string terminates on a downstream half of the ESP motor.

18. The ESP assembly of claim 13, further comprising a clamp, wherein the clamp couples the tubular shroud string to the production tubing.

19. The ESP assembly of claim 18, comprising a shroud inlet secured between the clamp and the tubular shroud string, the shroud inlet comprising at least one aperture coupling a space between a well casing and the tubular shroud string to an annular clearance between the tubular shroud string and the centrifugal ESP pump.

* * * * *